United States Patent [19]

Shimizu

[11] Patent Number: 4,850,904

[45] Date of Patent: Jul. 25, 1989

[54] CONNECTOR FOR TELEPHONE CABLES

[75] Inventor: Tatsuyoshi Shimizu, Tokyo, Japan

[73] Assignee: Minnesota Mining and Manufacturing Company, St. Paul, Minn.

[21] Appl. No.: 191,222

[22] Filed: May 6, 1988

[30] Foreign Application Priority Data

May 8, 1987 [JP] Japan ..... 62-68723

[51] Int. Cl.[4] ..... H01R 13/11

[52] U.S. Cl. ..... 439/856

[58] Field of Search ..... 439/680, 841, 856, 858, 439/861, 862

[56] References Cited

U.S. PATENT DOCUMENTS

| | | | |
|---|---|---|---|
| 3,112,974 | 12/1963 | Curtis et al. | 439/680 |
| 4,175,821 | 11/1979 | Hunter | 439/856 |
| 4,598,972 | 7/1986 | Mullen, III et al. | 439/861 |
| 4,720,276 | 1/1988 | Takahashi | 439/861 |

*Primary Examiner*—Joseph H. McGlynn

*Attorney, Agent, or Firm*—Donald M. Sell; Walter N. Kirn; John C. Barnes

[57] ABSTRACT

A low profile socket connector for use in making connection with printed circuit boards utilizing a contact element having a female contact portion including a stepped portion extending substantially parallel to a body portion and a curved contact piece extending from the stepped portion toward the body portion and a second contact piece extending from the body portion toward the first contact piece affording a double wipe with a pin element.

2 Claims, 4 Drawing Sheets

FIG. 1A
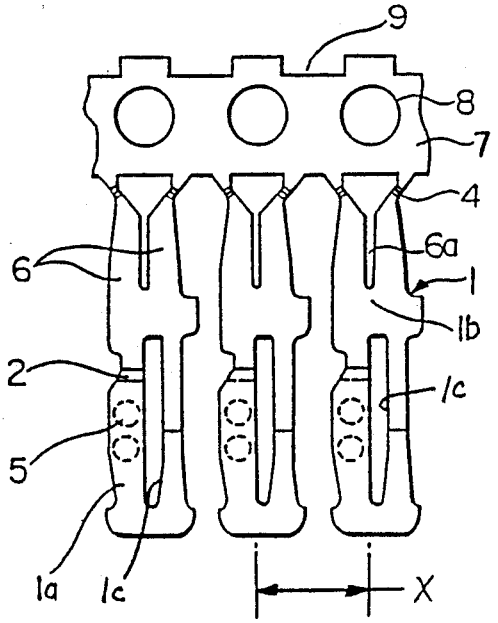
FIG. 1B
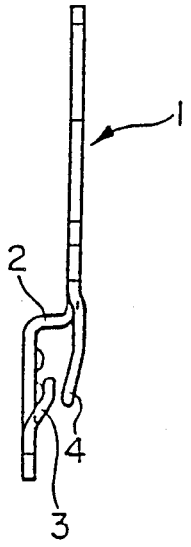
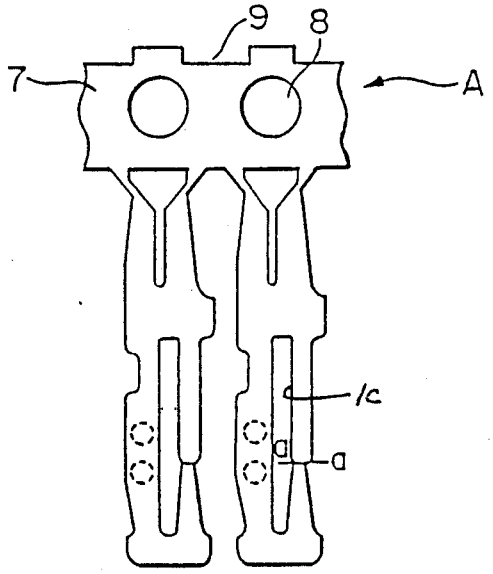
FIG. 2

FIG. 5
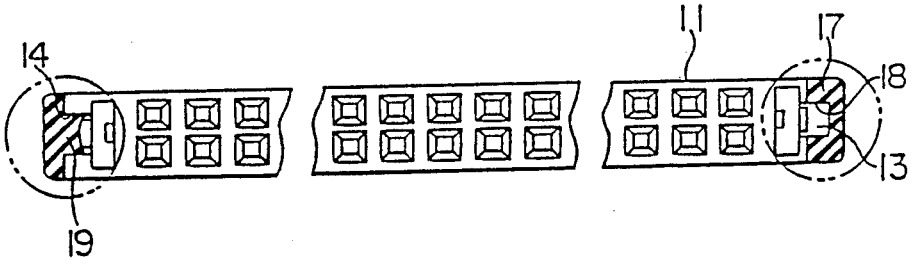
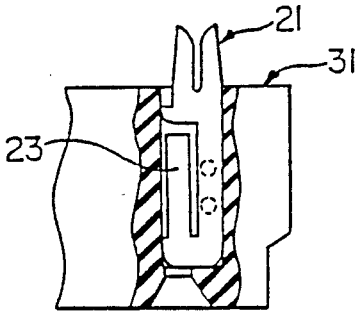
FIG. 6A
PRIOR ART
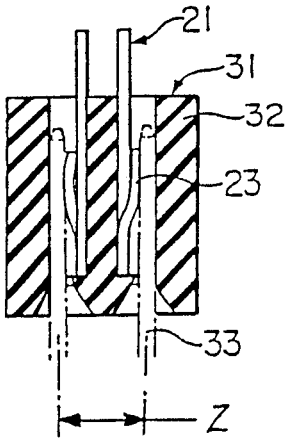
FIG. 6B
PRIOR ART

CONNECTOR FOR TELEPHONE CABLES

BACKGROUND OF THE INVENTION

1. Field of the Invention

The present invention relates to an electric connector of pressure-contact type for use in electric connection between printed circuit boards and electric wires such as a flat cable or the like and, more particularly, to contacts mounted in a female connector member.

2. Description of the Prior Art

The conventional contacts mounted in a female connector member of an electric connector include ones of single-point contact type and of double-point contact type. Each of the contacts of single-point contact type has a single curved contact piece which is adapted to be brought into contact with a corresponding one of male terminals of a male connector member. Each of the contacts of double-point contact type has two curved contact pieces confronting each other, in which a corresponding one of male terminals of a male connector member is clamped between the two contact pieces, to achieve electric connection. In general, these contacts are formed by stamping of an electrically conductive spring strip.

The above-mentioned contacts of single-point contact type are unsteady in electric contact as compared with the contacts of double-point contact type. Therefore, the electrically conductive sprint strip material used for the contacts of the single-point contact type is made thick to increase the resiliency in an attempt to achieve stability in electric contact. However, this results in an increase in a wall thickness of the female connector member having accommodated therein the contacts, so that the entire electric connector increases in thickness. This is an obstacle to an attempt to make compact office-automation equipment having mounted therein printed boards superposed one upon another.

The contacts of double-point contact type are superior in stability of electric contact as compared with the contacts of single-point contact type. However, a large blank layout is necessary for the contacts of double-point contact type, because the electrically conductive spring strip is bent into a C-shape. Thus, the contacts of double pointed contact type are wasteful.

SUMMARY OF THE INVENTION

According to the present invention, there is provided an electric connector in which a female connector member has mounted therein contacts each comprising a body portion having wire contact pieces, a stepped portion extending substantially in parallel to said body portion, a first curved contact piece extending from said stepped portion toward said body portion and a second contact piece extending from said body portion toward said first contact piece.

BRIEF DESCRIPTION OF THE DRAWINGS

FIG. 1A is a plan view showing contacts to be mounted in a female connector member of an electric connector according to the invention, the contacts being connected to each other in the form of a chain;

FIG. 1B is a side elevational view of the contacts shown in FIG. 1A;

FIG. 2 is a plan view of the contacts shown in FIG. 1A, which have been blanked from a blank, but which are prior to being subjected to bending and shearing;

FIG. 5 is a cross-sectional view showing the female and male connector members which mate with each other;

FIG. 6A is a partially broken-away plan view of a female connector member having mounted therein contacts according to the prior art;

FIG. 6B is a cross-sectional side view of the female connector member shown in FIG. 6A;

DESCRIPTION OF THE PREFERRED EMBODIMENT

Figure 3A:
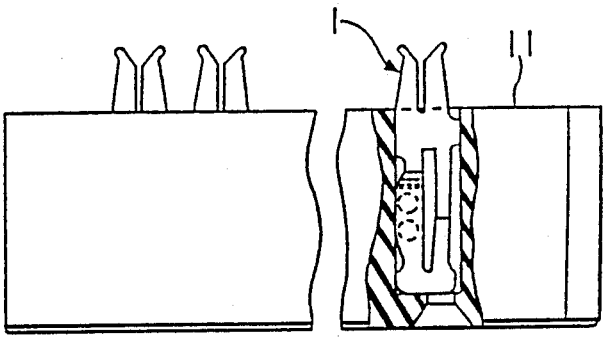
FIG. 3A is a partially broken-away plan view of the contacts shown in FIG. 1A, which are mounted in a body of the female connector member.

Referring to FIGS. 1A, 1B, and 2, there is shown contacts 1 to be mounted in a female connector member of an electric connector according to an embodiment of the invention. An electrically conductive spring strip is stamped into a semi-stamped article A in the form of a chain (see FIG. 2), to form the contacts 1. In this form a carrier 7, contact pieces 6, and a body portion **1*b* having a free end portion with a slot 1*c*** is formed, defining in said end portion a first side and a second side.

After shearing the second side along lines a—a, bending is applied to the semi-stamped article in the form of a chain, to form in the first side a bent portion 2 and first and second contact pieces 3 and 4 of each of the contacts 1. The first and second contact pieces 3 and 4 of each contact 1 are adapted to be in contact with a corresponding one of male terminals of a male connector member. Prior to being mounted in the female connector member, the contacts 1 are connected to a carrier 7 of the semi-stamped article A through respective connecting portions 4, as shown in FIG. 1A. Each contact 1 has a stepped portion **1*a* extending longitudinally from the bent portion 2 and formed with two engaging projections 5, and a body portion 1*b* provided with a pair of wire contact pieces 6. When the contacts are mounted in the female connector member, the engaging projections 5 are brought into engagement with an inner wall surface of the female connector member to prevent the contacts from shifting within the female connector member. The pair of wire contact pieces 6 of each contact 1 define therebetween a slot 6*a* into which a corresponding one of wires is adapted to be inserted. The carrier 7 is formed with pilot bores 8 and recesses 9** which are utilized in a plating step and a step of assembling the contacts with the female connector member.

Figure 3B:
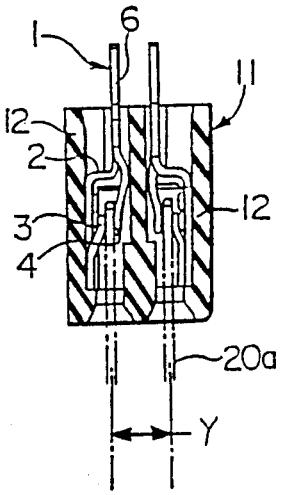
FIG. 3B is a cross-sectional side view of the female connector member illustrated in FIG. 3A.

Referring to FIGS. 3A and 3B, a plurality of contacts 1 are illustrated which are mounted in two rows in the female connector member 11. The contacts 1 in each row are arranged at a pitch of, for example, 2.54 mm.

Figure 4:
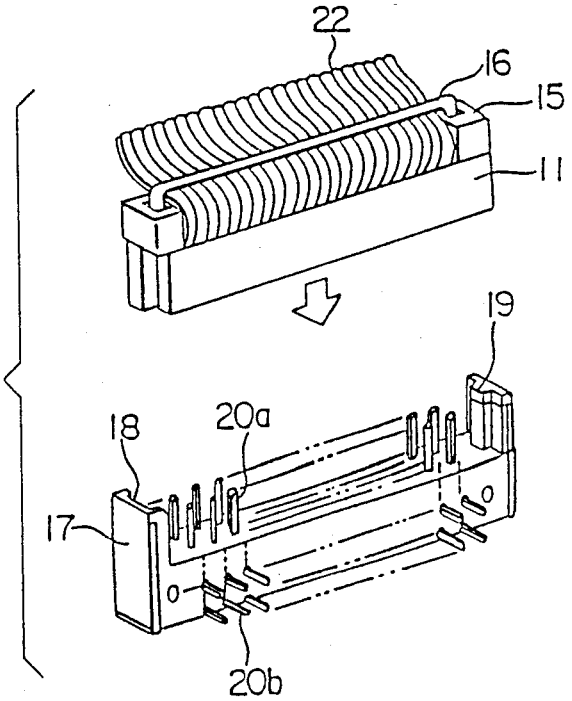
FIG. 4 is a perspective view of the female connector member shown in FIGS. 3A and 3B, which female connector member having attached thereto a flat cable is being fitted on a male connector member.

Male terminals 20*a* of the male connector member 17 as shown in FIG. 4 are arranged in two rows correspondingly to the contacts 1 in the female connector member 11. A pitch between each pair of adjacent contacts 20*a* in each row is 2.54 mm, and the spacing between the two rows is, for example, 1.905 mm. Male terminals 20*a* are connected to other male terminals 20*b*. FIG. 3B shows the male terminals 20*a* of the male connector member 17, each of which male terminals is in two-point contact with the first and second contact pieces 3 and 4 of a corresponding one of the contacts 1 of the female connector member 11.

Referring to FIG. 4, a flat cable 22 has a plurality of wires which are inserted respectively into the slots 6*a* between the wire contact pieces 6 of the contacts 1 within the female connector member, to bring the wires into metal-to-metal contact with the wire contact pieces 6. Then, the flat cable 22 is fixed to the female connector member 11 by a cover 15 and a cable retainer 16 thereof. Subsequently, the female connector member 11 is fitted on the male connector member 17. Each of the first male terminals 20*a* of the male connector member is brought into two-point contact with the first and second contact pieces 3 and 4 of a corresponding one of the contacts 1 in the female connector member, as shown in FIG. 3B. FIG. 5 illustrates, partially in cross-section, the female and male connector members 11 and 17 in fitted relation to each other, with the contacts and the male terminals not shown for clarification. A projection 13 and a recess 14 provided respectively at the opposite ends of the female connector member 11 mate respectively with a recess 18 and a projection 19 provided respectively at the opposite ends of the male connector member 17, to bring the polarities of the respective connector members into coincidence with each other.

Referring to FIGS. 6A and 6B, there is illustrated a female connector member 31 according to the prior art, in which contacts 21 are mounted. Each contact 21 is made of an electrically conductive spring strip having a large thickness, and has only one contact piece 23. The contacts 21 are different from the contacts 1 of the invention in that each contact 21 has no bent portion. As shown in FIG. 6B, each first male terminal 34 of a male connector member 33 is, on one side thereof, in single-point contact with a corresponding one of the contact pieces 23 of the female connector member, and is, on the other side, supported by a wall 32 of the female connector member. It is noted that the wall 32 of the female connector member 31 is made thick by the reason that the contacts of the female connector member are made of an electrically conductive spring strip having a large thickness, and the wall 32 has to support the male terminals 33 urged by the contact pieces 23 having strong resiliency.

Figure 7:
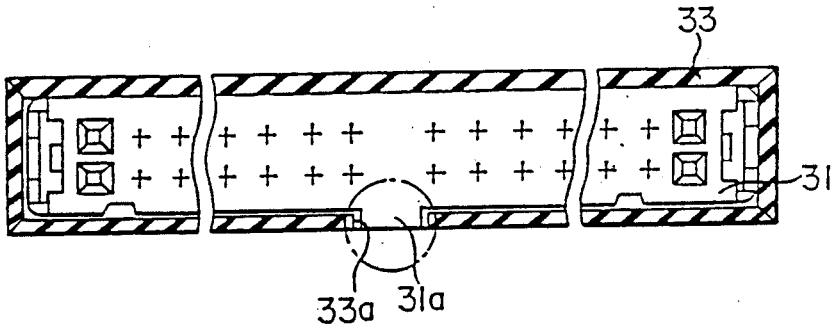
FIG. 7 PRIOR ART
FIG. 7 is a cross-sectional view showing the female connector member shown in FIG. 6A and a male connector member, which mate with each other.

Referring to FIG. 7, there is illustrated, partially in cross-section, the male and female connector members 33 and 31 in fitted relation to each other, with the contacts and the male terminals not shown for clarification. A recess 33*a* at the middle of the male connector member mates with a projection 31*a* at the middle of the female connector member, to bring the polarities of the respective male and female connector members into coincidence with each other. It will be seen, however, that the connector shown in FIG. 7 has its entire thickness greater than that of the fitted connector members of the invention shown in FIG. 5.

Figure 8:
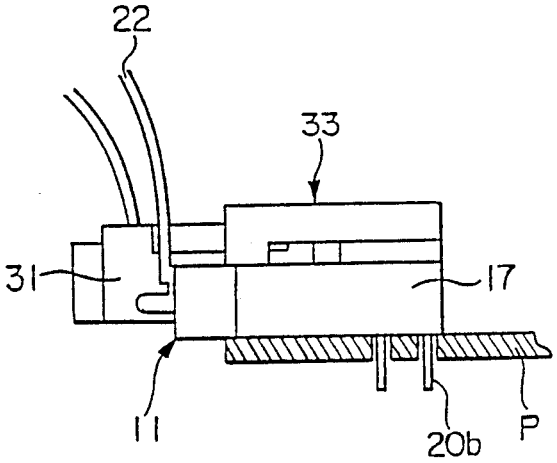
FIG. 8 is a side elevational view of a printed board having mounted thereon the electric connector according to the invention and the electric connector of the prior art.

Referring to FIG. 8, there is illustrated the electric connector 11, 17 according to the invention and the electric connector 31, 33 of the prior art, which connectors are mounted to a printed board P. It will be seen that the electric connector according to the invention is extremely compact in size.

The invention has the following effects:

1. Electric contact between the contacts of the female connector member and the male terminals of the male connector member is stabilized;

2. A small blank profile is sufficient for the contacts of the female connector member; and 3. The entire electric connector is small in thickness.

I claim:

1. A female socket connector adapted for connection to a pin connector member, said socket connector comprising a plurality of contacts each comprising a body portion having wire contact pieces at one end of said body portion and having a slot formed in the other end to define a first side and a second side of said other end, said second side being sheared to form first and second contact pieces, said first side having a stepped portion extending substantially in parallel to said body portion, said first contact piece extending from said stepped portion at the end thereof opposite said one end of said body portion toward said body portion and said second contact piece extending from said body portion toward said first contact piece whereby the ends of said first contact piece and said second contact piece are in opposed relationship.

2. A connector comprising a female socket connector according to claim 1 and a header male connector, said female connector having opposite ends, a recess formed in one end and a projection extending endwise from the opposite end, and said male connector having opposite ends, with a projection and a recess which are adapted to mate respectively with said recess and said projection of said female connector.

* * * * *